United States Patent [19]

Arndt

[11] Patent Number: 4,522,395

[45] Date of Patent: Jun. 11, 1985

[54] GAMES APPARATUS

[76] Inventor: Guenter Arndt, 511 Main Rd., Orewa, New Zealand

[21] Appl. No.: 576,178

[22] Filed: Feb. 3, 1984

Related U.S. Application Data

[63] Continuation of Ser. No. 169,914, Jul. 17, 1980, abandoned.

[30] Foreign Application Priority Data

Jul. 19, 1979 [NZ] New Zealand ..... 191056

[51] Int. Cl.[3] ..... A63B 67/18

[52] U.S. Cl. ..... 273/30; 273/367

[58] Field of Search ..... 273/30, 29 R, 29 A; 248/188.5; 272/74

[56] References Cited

U.S. PATENT DOCUMENTS

| | | | |
|---|---|---|---|
| 1,862,118 | 6/1932 | Kleinman | 273/30 |
| 3,288,421 | 11/1966 | Peterson | 248/163 |
| 3,452,985 | 7/1969 | D'Zmura | 273/30 |
| 3,797,825 | 3/1984 | Barrett | 272/74 |
| 3,888,444 | 6/1975 | Yendia | 248/188.5 |
| 3,889,945 | 6/1975 | Ellis | 273/8 |
| 3,980,304 | 9/1978 | O'Neill | 272/3 |
| 4,108,434 | 8/1978 | Royer et al. | 273/30 |

FOREIGN PATENT DOCUMENTS

| | | | |
|---|---|---|---|
| 4982 | of 1902 | United Kingdom | 273/30 |

*Primary Examiner*—Richard C. Pinkham
*Assistant Examiner*—T. Brown
*Attorney, Agent, or Firm*—Holman & Stern

[57] ABSTRACT

A table tennis game apparatus in which one or more players project a ball with a racquet over a net constituting a planar playing surface. The playing surface has a centrally disposed, rotatable hub extending vertically therefrom. A plurality of nets extend above and in a plane substantially across the playing surface. Each of the nets has one of its ends attached to the hub and its other end attached to the playing surface.

7 Claims, 16 Drawing Figures

GAMES APPARATUS

This is a continuation of application Ser. No. 169,914, filed July 17, 1980, abandoned.

BRIEF SUMMARY OF THE INVENTION

This invention relates to games apparatus and it particular to apparatus allowing improvement and/or modifications to the game of table tennis, however, the apparatus can also be used to develop skills in other games involving the combination of ball and bat or racquet such as badminton, squash, tennis etc.

In one aspect the invention consists in, games apparatus comprising a playing surface; net means mounted or mountable on said playing surface to extend at least partially across said playing surface; and at least one integer selected from the group comprising:

- at least one reflecting means mounted or mountable on or adjacent to said playing surface to project thereabove;
- at least one aperture means defining or including an aperture mounted or mountable on said playing surface so that said aperture is spaced above said surface;
- at least one receptacle mounted or mountable on or defined within said games playing surface, said integer and said net means being constructed and arranged on said playing surface to ensure interaction with both by a player projecting a ball using a racquet, bat or the like.

In a further aspect the invention consists in games apparatus comprising:

- a games playing surface; at least one integer selected from the group comprising; net means mounted or mountable on said playing surface to extend at least partially across said playing surface;
- at least one reflecting means mounted or mountable on or adjacent to said playing surface to project thereabove;
- at least one aperture means defining or including an aperture mounted or mountable on said playing surface so that said aperture is spaced above said surface;
- at least one receptacle mounted or mountable on or defined within said games playing surface;
- and means to move said at least one integer with respect to a static player.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

Embodiments of the invention will now be described with reference to the accompanying drawings in which.

DETAILED DESCRIPTION

Figure 1:
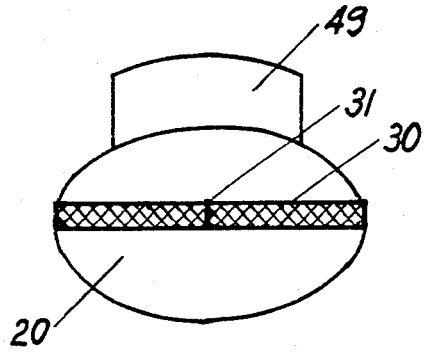
FIGS. 1 to 6 show schematic illustrations of examples of combinations of games apparatus according to the invention.

Each of the individual components of the invention will be described separately, however, it will be appreciated that the various components may be intercombined in different forms to produce various combinations of games apparatus which may be used to play various games and/or develop particular skills.

According to the invention and as depicted in the drawings the playing surface is preferably in the form of a plane circular table 20, however other configurations of table are envisioned including various polygonal and/or nonplanar configurations. Alternatively such as the elliptical surface (as shown pecked in FIG. 12) and the rectangular configuration are shown included on the playing surface depicted in FIG. 12.

Figure 12:
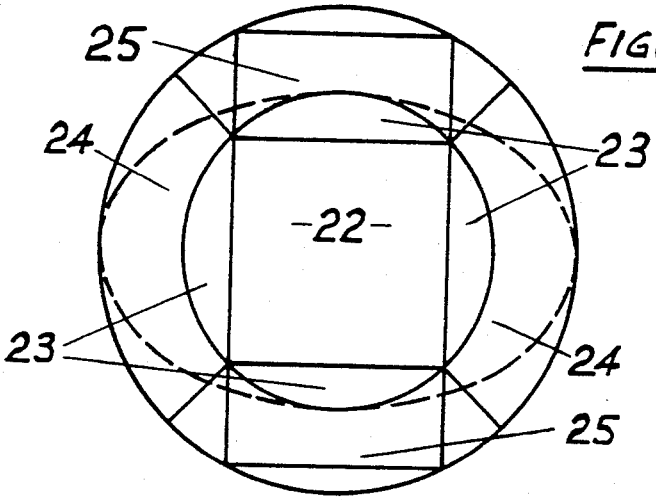
FIG. 12 shows a plan view of one example of a modular playing surface for use in apparatus according to the invention.

The table may be formed by one or a number of interfitting and/or folding members or as shown in FIG. 12 the playing surface may be formed from a number of modular components which in addition to providing a playing surface of the same shape and size as a conventional table tennis table, also provide other variations. As shown two or more circular tables of different diameters may be achieved. More particularly a central square base surface 22 is provided to which four identical arcuate sectors 23 may be added to provide a circular table of a first, smaller diameter. Further appropriately shaped border sectors 24 and/or 25 may be added to provide a further playing surface of larger diameter. In the form shown the larger diameter table is just large enough to accommodate a standard rectangular table tennis play area therein, the borders of which are indicated by the lines defining the larger rectangle in FIG. 12.

The playing surface may be plain and unmarked, the playing divisions being defined by the addition of other components such as nets or the like or alternatively games areas may be defined on the surface, at least in part, by line markings and/or areas of different colouring (not shown). Because of the variable net configuration hereinafter described, the serving or other lines may be indicated by movable radially extending tapes or the like.

Portions of the playing surface not in use or defining penalty areas may be rendered non-rebounding by covering them with some non-rebounding material such as a soft rubber, cloth or foam material.

Figure 13:
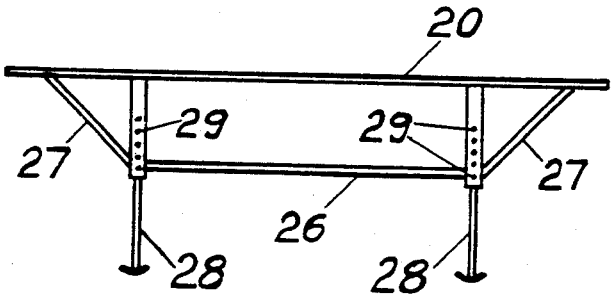
FIG. 13 shows an elevational view of one form of static support for a playing surface employed in apparatus according to the invention.

The playing surface may be mounted on any suitable base. In FIG. 13 one form of static mounting is shown suitable for mounting any of the playing surfaces depicted in the previous figures and particularly suitable for mounting the playing surfaces depicted in FIG. 12. As can be seen the mounting comprises a simple rectangular central frame 26 which may have arms 27 projecting therefrom to locate and/or support the arcuate components added to provide the larger playing surfaces. It will be noted that the legs 28 of the central frame 26 are preferably adjustable in length and this not only enables the height of the table to be adjusted in planes parallel to the ground, but also allows the table to be tilted i.e. the playing surface to be set to various angles of inclination, and thus provide a more challenging game.

In the FIG. 13 embodiment, the adjustment is provided by providing apertures 29 in each of the legs and leg guides. Thus the desired height or tilt can be achieved by aligning pairs of holes in the appropriate legs and the leg guides and inserting a pin (not shown). It will be appreciated however that many different forms of adjustment such as ratchet adjustment or friction clamps could be used to achieve the same result.

Although the playing combination selected does not necessarily have to include any barrier means such as nets, the invention will be described with reference to constructions including the provision of one and preferably a plurality of nets 30 over which in use balls are projected by players using bats, racquets or the like. The position of the nets when used in combination with other components will inevitably depend on the position of the other components with which the nets are to be combined for games purposes.

As shown in FIGS. 1 and 3 to 6 inclusive, the nets 30 preferably radiate from a central point which may be in the form of a mast 31 mounted at the geometric centre of the games surface 20. It will be appreciated however that the nets need not be placed at the centre of the playing surface but may be placed at any desired position thereon to project thereabove according to the rules determined prior to the game commencing.

Figure 2:
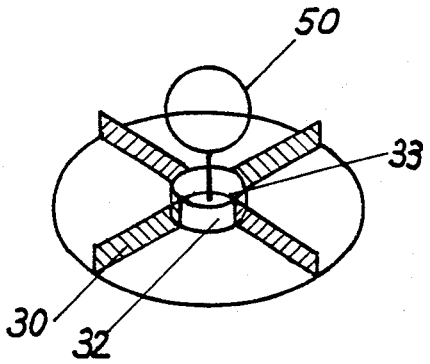
Figure 11:
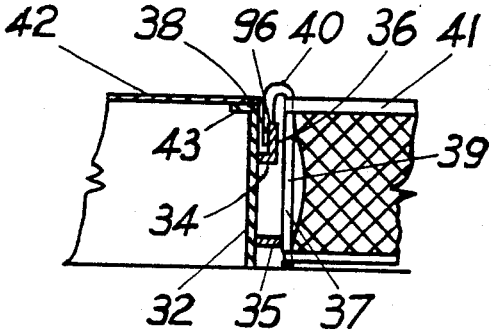
FIG. 11 shows an enlarged partial cross-sectional view of one form of mounting a net to a central hub in apparatus according to the invention.

An alternative arrangement is shown in FIG. 2 in which the inner ends of the nets 30 are attached to a larger central hub 32 the centre 33 of which defines a "no play" area. One form of attachment of the nets to the central hub 32 is shown in FIG. 11. As shown the hub includes a pair of spaced circumferential rings 34 and 35 extending about the periphery thereof, the ring 34 including an upturned flange 36. The net end is attached to a pin 37 having a short leg 38 and a long leg 39 joined by a central U-section 40. In use the short leg 38 is engaged and maintained in contact behind flange 36 by the tension in the top strap 41 of the net. The short leg 38 preferably has a flat 96 cut therein to engage against the flange 36. The torque imparted to pin 37 by the strap 41 is reacted by ring 35. It will be appreciated that this arrangement allows the inner ends of the nets to be positioned at any point around the circumference of hub 32. Furthermore, this particular adjustment may be effected easily and swiftly by a person standing at the periphery of the table, i.e. without major equipment changes and interruptions to the game. While referring to FIG. 5 it will be noted that the hub may include a cover member 42 supported by radially spaced lugs 43 to prevent balls entering the central area 33. The cover member 42 may preferably be conical (not shown) to facilitate ball return to the table periphery.

The outer end of each net is preferably supported by a further post 44, the lower end of which may be slidably engaged in a slot or channel (not shown) extending around the edge of the playing surface or alternatively the posts 44 may be fixed in place using conventional U-clamps (not shown), attached to the lower ends thereof. The nets may of course be fixed at positions other than the table edges by using suitable posts engaged with the playing surface or otherwise.

Figure 3:
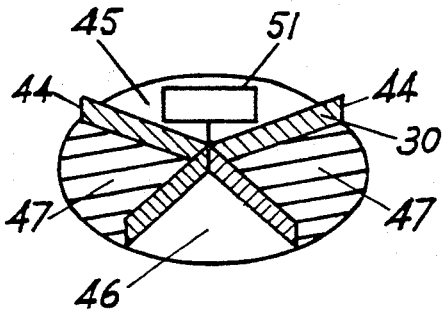

The multi-adjustability of the nets 30 allows a first form of handicapping to be introduced. Referring to FIG. 3 the nets 30 have been adjusted to define two playing areas 45 and 46 of different sizes, and thus a more skilled player could be required to place the ball in the area 46 while the less skilled player could be required to place the ball in area 45. Further handicapping may be introduced by designating areas 47 "out of bounds" and possibly covering these areas with non-reboundable overlays. Alternatively the areas may be used for play by two more players of similar skill.

Figure 5:
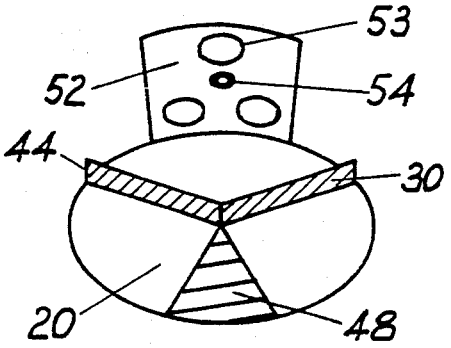

It will be appreciated that the playing areas need not be defined solely by the use of the nets 30 but may be defined in part by the nets and in part by surface markings or overlays such as 48 as shown in FIG. 5.

The nets 30 described hereinabove may be attached to the playing surface either singly or in combination with reflecting means attached to or adjacent to the playing surface 20 to project thereabove.

In FIG. 1 a simple curved reflecting means 49 is depicted provided on an edge of the playing surface 20. It will be appreciated that such a reflector need not be provided on the edge of the playing surface but could be placed at any point thereon so long as, in combination with the other components (in FIG. 1 for instance, the nets 30) it is possible for players to combine the effect of both components. In the FIG. 1 embodiment for example, the player or players would be required to project a ball over the net 30 and onto the reflector 49 or alternatively onto the reflector then onto the playing surface 20 and over the net 30. As still a further alternative the players would be required to play the ball onto the reflector 49 over the net 30 and onto the playing surface 20.

The reflector 49 is shown as a simple curved member however it could be a complexly curved member i.e. part spherical or parabolic, or could be a plane member. Further a reflector could include combinations of plane, simple curved and/or complexly curved surfaces.

The reflector may be positioned perpendicular to the playing surface 20 or may be inclined thereto. It may be fixed with respect to the playing surface or alternatively means may be incorporated by which the reflectors may rotate, change inclination, and/or translate with respect to the playing surface. The reflecting means may be used singly or in combination with the nets 30 or any of the other integer means to be described.

Figure 9:
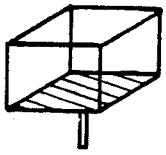
Figure 10:
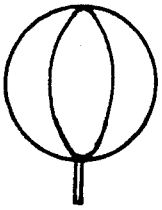

A still further integer of the invention comprises aperture means defining or including an aperture through which, in use, balls may pass projected by players using racquets, bats or the like. FIGS. 2 and 3 depict two simple forms of such aperture means mounted on the playing surface 20 comprising simple frame members supported above the playing surface. In the FIG. 2 embodiment, the aperture means comprises a circular frame member 50 supported above the center of the playing surface 20 while in FIG. 3 the aperture means comprises a simple rectangular frame member 51 supported above the centre of the playing surface. FIGS. 7 to 10 inclusive show various further possible configurations of frame member in a larger scale, FIGS. 9 and 10 depicting space frame members which include apertures in two or three dimensions through which more skilled players could be required to project balls according to the flexible rules of the game. In addition the frame members could be formed from a pliable material to allow the players to select any desired shape of aperture.

It should be appreciated that the examples depicted are not intended to be exclusive of other possibilities.

Referring now to FIG. 5, this form of aperture means is provided in combination with reflecting means and accordingly the curved reflecting surface 52 has apertures 53 provided therein. Thus should a ball fail to engage one of the apertures 53 it will rebound from the reflecting surface 52.

The FIG. 5 embodiment further exemplifies the use of a ball ejecting means or robot indicated by the reference numeral 54 which may, in use, eject balls onto the playing surface 20 and require players to project the balls back, either into one of the apertures 53 or on to the reflecting surface 52 according to the predetermined flexible rules of the game.

Figure 4:
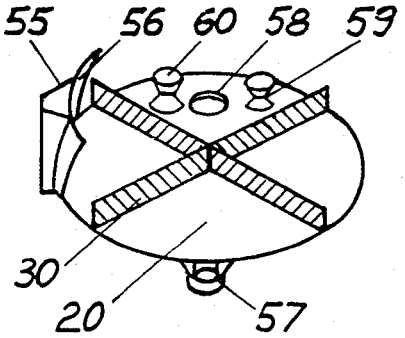

Referring now to FIG. 4, ball collection means 55 may be provided behind the apertures (not shown) in the reflector 56 to receive balls passing through the apertures and deliver them to the ball ejecting means (not shown) or to a remote point such as is indicated by reference numeral 57 on the periphery of the surface 20 convenient to the player.

As with the reflecting means, the aperture means may be fixed at any suitable point on the playing surface to project thereabove or may rotate and/or translate over the working surface. Further the aperture means may be used singly or in combination with the nets 30, or may be used in combination with one of the other forms of aperture means or may, as shown in FIGS. 4 and 5, be used in combination with the reflecting means described and/or the other integers to be described.

FIG. 4 depicts a form of the apparatus in which the games playing surface 20 is provided with a ball receiving receptacle indicated by the reference numeral 58 set into the surface thereof and into which in use balls may be projected by players. The apertures 58 may be provided at any desired point on the games playing surface.

Figure 6:
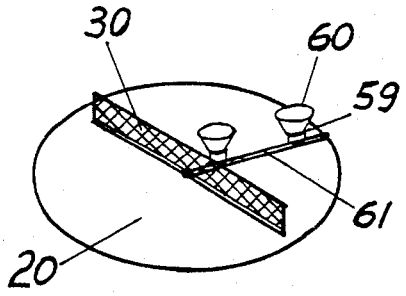
Figure 7:
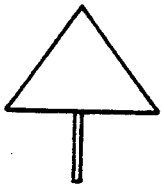
FIGS. 7 to 10 show schematic illustrations of alternative examples of aperture means for use in the invention.
Figure 8:
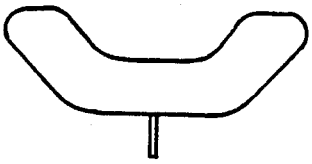

An alternative form of further receptacle is shown in FIGS. 4 and 6 in which the receptacle takes the form of a cone 59 mounted so as to project above the games playing surface. The mouth 60 of each cone is preferably adjustable e.g. swivelable. The cones 59 may be fixed, as shown in FIG. 4, in any suitable position in the games playing surface or alternatively the cones may be mounted so as to move with respect to the games playing surface. As shown in FIG. 6 the cones 59 are mounted on a radial arm 61 pivotally mounted in the centre of the playing surface 20 and thus may rotate over the playing surface. Other means as will be described hereinafter may be provided to enable the cones to translate on the playing surface.

Referring to FIG. 4, when fixed receptacles are used, ball return means may be associated with the receptacles to return the balls to some position 57 convenient to the player. These may comprise simple gravity feed systems or may include more sophisticated power operation.

Figure 14:
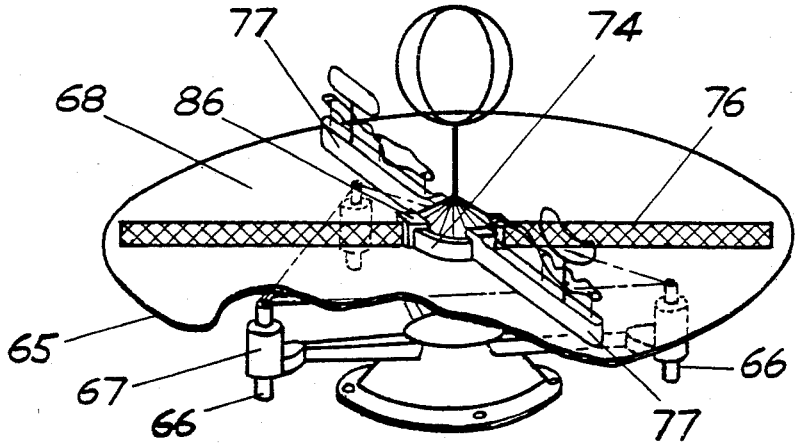
FIG. 14 shows a perspective schematic view of one form of dynamic games apparatus according to the invention.
Figure 15:
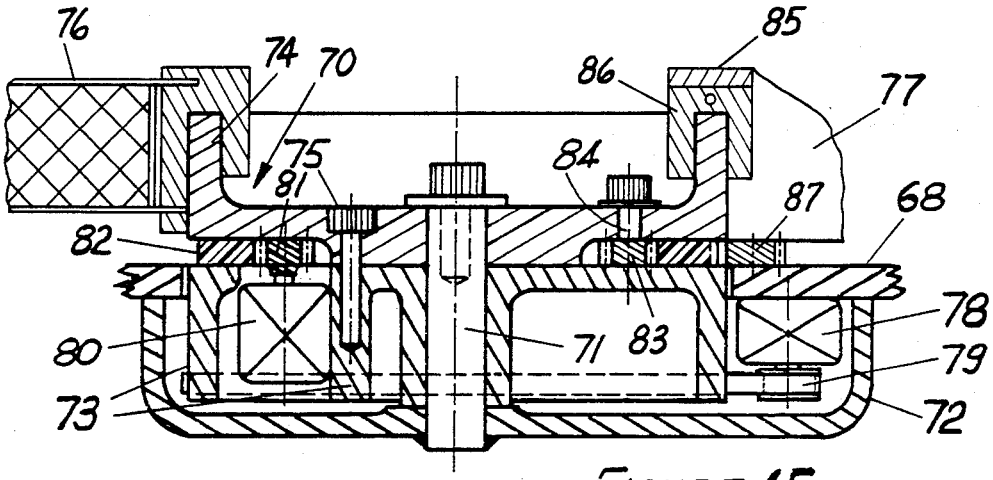
FIG. 15 shows an enlarged cross sectional view of the central hub and drive arrangement of the apparatus shown in FIG. 14.
Figure 16:
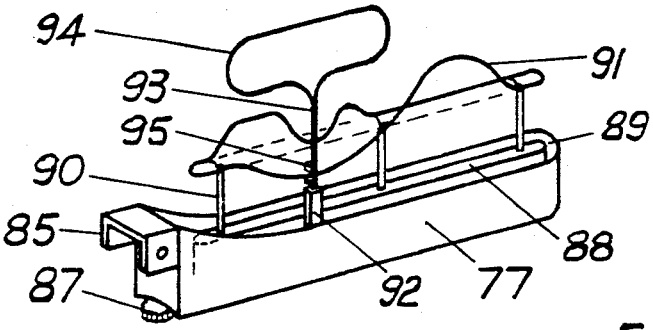
FIG. 16 shows an enlarged perspective view of the integer mounting arm mounted on the hub shown in FIG. 14.

The constructions described above have been essentially static in form i.e. the nets and other integers have been fixed with respect to the playing surface and the playing surface itself has been fixed. Referring now to FIGS. 14 to 16 games apparatus according to the invention may also be provided which is dynamic in form i.e. in which the nets and other integers move with respect to the playing surface and/or the players. The type of movement may be rotational and translational in directions parallel to the plane of the playing surface and perpendicular thereto. Further, combinations of rotational and translational movement may be provided. These movements in whatever form, are also useful in developing skills applicable to tennis, badminton and squash.

Owing to the relatively small weight of the nets and other integers used in the embodiments so far constructed, I have found that it is easier and cheaper to provide means to rotate the nets and other integers with respect to the playing surface rather than to rotate the entire playing surface. Thus the only movement imparted to the playing surface in the embodiment described herein is translational movement in a direction substantially perpendicular to the plane thereof, i.e. plane vertical motion, see-saw type oscillating motion, and wobbling motion as will be described hereinafter. It will be appreciated however that as the apparatus becomes larger and the integers more complicated and heavier it may become simpler to rotate the whole playing surface.

As shown, in the particular embodiment of FIG. 14, playing apparatus 65 is provided supported on substantially equally spaced base control members 66. Each of these base control members 66 includes a length varying mechanism 67 therein so that the length of each leg may be increased or decreased. By way of example, the mechanism 67 could comprise a rack and pinion, a worm and nut arrangement, or a hydraulic or pneumatic piston/cylinder arrangement. Combined with each mechanism 67 is a power source (not shown) to enable the means 67 to be actuated to vary the length of the base control members 66. Further, control means (not shown) is perferably provided to control the operation of each of the mechanisms 67.

It will be appreciated that by actuating each of the mechanisms 67 at the same time, and in the same manner and for the same length of time, the playing surface 68 may be translated up and down substantially perpendicularly to the plane thereof. By cyclically operating and reversing the mechanisms 67 however, a form of tilting and/or wobbling motion may be imparted to the playing surface 68.

The control means (not shown) is such that the motive power for each means 67 is separately controllable so that the extensions of each leg 66 can be fixed in any desired position to impart any desired fixed attitude to the playing surface in much the same manner as the legs of the apparatus depicted in FIG. 13, may set the inclination of the playing surface to the desired degree.

Referring more particularly now to the cross section shown in FIG. 15, a central hub 70 is provided which is preferably rotatable with respect to the playing surface 68, the hub 70 as shown being mounted on a central shaft 71 retained in a cage 72 mounted on the underside of the playing surface 68. The hub is preferably provided in two parts. The first part, indicated by reference numeral 73 constitutes the drive housing and is mounted substantially beneath the playing surface 68. The second part 74 of the hub is axially engaged with the part 73 by through bolts 75 and projects above the playing surface 68 to serve as a mounting for the nets 76 and the integer mounting arms 77.

A first motor 78 is mounted on the underside of the playing surface 68 and drives a belt 79 which engages the outer periphery of the drive housing portion 73 and thereby rotates the hub assembly. Within the hub a further motor 80 is mounted which rotates with the hub. An output drive gear 81 is mounted on the output shaft of the motor 80 and this gear 81 transmits torque to the internal periphery of sun gear 82 which is mounted concentrically with the shaft 71. Two idler gears, one of which is indicated by reference numeral 83, are provided, mounted on shafts 84 equi spaced about the underside of hub portion 74 from the output gear 81 to maintain the sun gear 82 concentrically with the shaft 71. The outer periphery of the sun gear 82 is also provided with means to impart drive to the integer mounting arms 77 in a manner as will be described hereinafter. This means may comprise gear teeth or may merely comprise a friction surface.

Referring now to FIG. 16 the integer mounting arms 77 each comprise hollow tubular members having a bracket 85 at one end thereof constructed and arranged to engage clamping members 86 which may be positioned and clamped anywhere along the circumference of the upper or mounting portion 74 of the central hub 70 so that the arms 77 project radially from the axis of the hub. Mounted so as to project from the lower edge of the end including the bracket 85 is a gear 87 which, when the arm is clamped onto the central hub, engages with the corresponding geared surface of the sun gear 82 and thus when motor 80 is activated, drive is imparted to gear 87. Within the arm 77 is mounted an endless belt (not shown) which is driven by the gear 87 and this belt extends around island 88 mounted centrally within the arm 77 so as to extend adjacent to or even through an open side 89 of the arm. Mounted at spaced portions on the central island 88 are a plurality of guide support posts 90 which support a guide track 91 in the form of a closed loop. The support track is preferably formed from some self-supporting yet pliable material such as metallic wire which can be readily changed to different shapes yet retains its shape when left alone.

Attached to the endless drive belt (not shown) within the arm 77 is an obstacle drive arm 92 and telescopically mounted within the arm 92 is a mounting arm 93 to the top of which is attached in the embodiment depicted, aperture means 94. However it will be appreciated that one of the other integers described hereinabove could be substituted for the aperture means 94. Further, more than one such integer may be mounted on one arm 77, i.e. several drive arms 92 may be provided on the drive belt.

It will be seen that the mounting arm 93 includes a pair of projecting pins 95 which engage either side of the guide track 91 and thus as the arm 92 is displaced about the track by the drive belt (not shown) the mounting arm 93 is telescoped up and down as the pins 95 follow the contour of the track 91.

Thus when motor 78 and motor 80 are operating the integer arm 77 not only rotates over the playing surface with the central hub 70 but further the aperture means 94 translates along the arms 77 thus requiring a considerable skill on the part of the player to project a ball through the aperture 94, or should a reflector be substituted for the aperture 94, to reflect a ball from either side of this reflector.

The nets 76 depicted in FIG. 14 are preferably mounted between parallel arms spanning radially from the central hub and supported entirely from the hub, however rollers or the like (not shown) may be provided at the outer ends of the nets or indeed the integer arms 77, to support some of the mass thereof.

The control of all the motions may be variable. Thus for the embodiment shown, the control of the three variable height mechanisms 67 and the two drive motors 78 and 80 may either be set to a fixed set of values, or preferably means may be provided whereby all these motions may be pre-programmed to interact in a synchronized or randomized fashion. Such means may consist of microprocessor control or electrical or pneumatic or other programmed sequence controllers which the players may set prior to the game commencing.

In use the player or players select what integers they so choose and if appropriate, select a static or dymanic configuration and use or formulate rules depending on the particular combination of integers mounted on the games playing surface, the object being to combine the integers in such a manner as to enable players using racquets or bats and at least one ball to place the balls on the playing surface so as to interact with the integers thereon and, if appropriate, work in with other players.

By way of example, the racquets and balls used are preferably conventional table tennis equipment and accordingly by mounting a simple net as depicted in FIG. 1 across the games playing surface a substantially conventional game of table tennis may be played using the equipment. If one player or team of players is markedly better than the other then a form of handicap can be simply incorporated by rearranging the nets 30 to the arrangement depicted in FIG. 3 and defining or adding in non-playing areas 47. Thus the more skilled player or team will have a lesser area in which to pitch the ball and will have to move more around his/its own larger area.

If a player wishes to practice the game singly then he may elect to mount a reflector means on the opposite side of the net to which he is positioned or alternatively arrange an aperture means or combined aperture and reflector means on the games board as shown in FIGS. 4 and 5. As a further alternative he could employ a receptacle means. The reflector means depicted in FIG. 1 will, if engaged in the proper manner, return balls to the player while the FIGS. 4 and 5 embodiments either rebound the balls or alternatively receive the balls through the apertures therein. The apertures may be linked to suitable ball returning apparatus in the form of ducts leading from behind the apertures to the opposite edge of the playing surface adjacent where the player is standing.

If more than two players or teams wish to use the apparatus then further nets may be added, as depicted in FIGS. 2 to 4 to define further playing areas or alternatively or in addition markings may be provided, as shown in FIG. 5 to define further playing areas. Thus three players or teams would require three radial nets, five players five nets etc. It will be appreciated that other numbers of players or teams can also be accomodated.

It is further possible to use the apparatus according to the invention so that queues or rows of players may play from one playing area, a selected or random person in the queue or row playing the shot and then moving away so that the next selected or random player may move to receive and pass the next return.

Since the playing areas are preferably circumferentially adjacent the players may elect to play shots either across the playing surface or circumferentially therearound according to rules formulated, or may be required to play some shots circumferentially and some shots transversely.

It will further be appreciated that apparatus as depicted in FIGS. 2 to 4 and 14 and variations thereof enable more than one game to be played simultaneously, i.e. players standing adjacent diametrically opposite portions of the playing surface may play as a pair with each other and independently of circumferentially adjacent players, the balls of each playing pair, crossing substantially the center of the playing surface.

The aperture means and the receptacle means are intended to improve the challenge to, and the ball placement skills of players and accordingly may be used either singly, in different combination of like components, or in combinations of receptacle and aperture means. Still further these integers may be used in combination with the barrier means herein described. In use aperture means such as depicted in FIGS. 2, 3 and 14 may again provide some form of handicapping whereby a less skilled player merely is required to project the ball from one playing area to the other whereas the skilled player may be required to return the ball through the aperture means. Likewise in the FIG. 5 embodiment a player may select which aperture 53 he is to place the ball in and score different points depending on whether or not that aperture is engaged. Such a player may project balls initially in his possession or alternatively return balls ejected by the ball ejector nozzle or robot 54.

It will be appreciated that the difficulty of all the exercises exemplified above may be increased by imparting motion to the games playing surface using, for example, the apparatus described with reference to FIGS. 14 to 16.

The advantages of the invention, at least in the preferred embodiments described above are believed to include the following:

Better space utilization: Compared to conventional table tennis, the new system leads to considerable space savings (e.g. floor area needed per player), making it particularly relevant to high-density living areas and low-resource organisations such as, for example, cities, high-rise flats, hospitals, schools, social clubs.

Increased participation: As a consequence of the apparatus more people may have the opportunity of participating in physically and mentally stimulating exercise.

Increased variety and challenge: The apparatus provides players with different degrees of challenge and difficulty, both intellectually and physically, from a simple "trick" game to a physically and mentally demanding competitive standard. In this regard it is believed to be superior to the conventional game of table tennis.

Social advantages: Since more than four players may participate simultaneously, personal and group interaction is fostered. This is of special significance in recreational and school activities.

Solo Play: One player may play alone. This increases the flexibility of the game and is not possible with the conventional table tennis game.

More equitable scoring system: The complete breakaway from the conventional game allows the introduction of a new, fairer, and less chance-dependent scoring system, than that used heretofore.

Used by people previously excluded from playing table tennis: The fixed table height and other constraints of the conventional game makes it unsuitable for small children/persons and for elderly or handicapped people. This is overcome in the invention by the multiplicity of possible equipment configurations and new game concepts.

The invention can also be used for tennis, badminton and squash type games. For tennis type games the features of handicaps, nets, reflectors and apertures and the choice of stationary and moving elements may be used.

For badminton type games these are again relevant except the element of reflectors.

For squash type games the ejector and reflectors, including curved reflectors may be used.

What is claimed is:

1. Games apparatus of the type wherein one or more players project a ball with a racquet, bat, or the like, comprising, a planar playing surface defining a playing area on and above said surface; means to vary the inclination of said playing surface; a plurality of nets removably mounted on said playing surface to extend at least partially across said playing surface and with longitudinal axes projecting from a common point; and at least one removably mounted target means within said playing area disposed above said surface in vertical spaced relationship to said surface and said nets and cooperatively associated with said playing surface with which said ball must interact as an object of the game, said target and said nets being constructed and arranged with respect to said playing surface so that either said target or said nets, or both, may selectively be utilized to provide interaction by a player projecting said ball, and further comprising a cylindrical hub substantially centrally located on said surface, means to adjustably and removably attach the inner end of each net to said hub, said hub and attachment means being constructed and arranged so that the nets can be attached at any point about the periphery of said hub, and means to adjustably attach the outer ends of said nets to said playing surface.

2. Games apparatus as claimed in claim 1 wherein said common point is located approximately at the geometric center of said playing surface.

3. Games apparatus of the type wherein one or more players project a ball with a racquet, bat, or the like, comprising: a ball; a planar playing surface defining a playing area on and above said surface; means to vary the inclination of said planar playing surface comprising a base, a plurality of adjustable legs mounted on said base, means to support said playing surface on said legs and means to vary the length of said legs; net means removably mountable on said playing surface to extend at least partially across said playing surface; at least one removably mountable target means within said playing area disposed above said surface in vertical spaced relationship to said surface and said net means and cooperatively associated with said playing surface with which said ball must interact as an object of the game, said target means comprising a frame member having a ball receiving aperture therein and said target and net means being constructed and arranged with respect to said playing surface so that either said target, or said net means, or both, may be utilized to selectively provide interaction with both by a player projecting said ball; a hub mounted for rotation about the geometric center of and with respect to said playing surface; means to rotate said hub with respect to said playing surface; means to operatively connect said target means and said net means to said hub; and means to support said target means and said net means so that they rotate with said hub.

4. Apparatus as claimed in claim 3 wherein said means to operatively connect said target means to said hub comprises target means bearing arms mounted on and rotatable with said hub.

5. Apparatus as claimed in claim 4 wherein said target means bearing arms include means to translate said target means along said arms.

6. Games apparatus of the type wherein one or more players project a ball with a racquet, bat, or the like, comprising, a planar games playing surface defining a playing area on and above said surface; means supporting said playing surface above the ground; a rototable hub projecting vertically upwards from the geometric center of said playing surface; means to rotate said hub; and net means mounted on said hub for rotation therewith, said net means extending above and across said playing surface in a plane substantially perpendicular to said playing surface.

7. Games apparatus of the type wherein one or more players project a ball with a racquet, bat, or the like, comprising: a circular planar playing surface defining a playing area on and above said surface; a plurality of adjustable legs mounted on the underside of said playing surface and means to vary the length of said legs for adjusting the inclination of said playing surface; net means removably mounted on said playing surface to extend radially across said playing surface; a cylindrical hub member projecting from said playing surface at the geometric center thereof; means to adjustably and removably attach the inner end of each net means to said hub, said hub member and attachment means being constructed and arranged so that said net means can be attached at any point about the periphery of said hub; means to adjustably support the outer ends of said net means adjacent the edge of said playing surface; and at least one removably mounted target means within said playing area cooperatively associated with said playing surface with which said ball must interact as an object of the game comprising an aperture means in the form of a three-dimensional ball receiving space frame mounted above said playing surface formed from a pliable material so that the shape of the aperture may be varied.

* * * * *